US006898404B2

(12) United States Patent
Sakai et al.

(10) Patent No.: US 6,898,404 B2
(45) Date of Patent: May 24, 2005

(54) LIQUID DEVELOPMENT ELECTROPHOTOGRAPHIC DEVICE

(75) Inventors: Satoshi Sakai, Kanazawa (JP); Isao Nagata, Tsubata-machi (JP); Hironaga Hongawa, Uchinada-machi (JP); Shigeharu Okano, Hakui (JP); Eri Yamanishi, Hakui (JP); Yutaka Nakashima, Kanazawa (JP); Akihiko Inamoto, Uchinada-machi (JP); Tadashi Nishikawa, Tsubata-machi (JP); Norihiro Yamasaku, Oyabe (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 10/466,485

(22) PCT Filed: Aug. 5, 2002

(86) PCT No.: PCT/JP02/07947

§ 371 (c)(1),
(2), (4) Date: Jul. 16, 2003

(87) PCT Pub. No.: WO03/017008

PCT Pub. Date: Feb. 27, 2003

(65) Prior Publication Data

US 2004/0047656 A1 Mar. 11, 2004

(30) Foreign Application Priority Data

Aug. 21, 2001 (JP) ..... 2001-249815
Dec. 26, 2001 (JP) ..... 2001-394635

(51) Int. Cl.[7] ..... G03G 15/10
(52) U.S. Cl. ..... 399/249; 399/237
(58) Field of Search ..... 399/237, 239, 399/240, 249, 250, 251, 345, 348, 350, 351, 352, 353, 354

(56) References Cited

U.S. PATENT DOCUMENTS

| | | | | | |
|---|---|---|---|---|---|
| 5,723,251 | A | * | 3/1998 | Moser | 430/126 |
| 5,937,250 | A | | 8/1999 | Kwak et al. | |
| 5,974,292 | A | * | 10/1999 | Domoto et al. | 399/249 |
| 6,253,051 | B1 | | 6/2001 | Iikura et al. | |
| 6,512,907 | B2 | * | 1/2003 | Nishikawa | 399/249 |

FOREIGN PATENT DOCUMENTS

| | | |
|---|---|---|
| JP | 54-038134 | 3/1979 |
| JP | 56-057078 | 5/1981 |
| JP | 02-093664 | 4/1990 |
| JP | 02-123383 | 5/1990 |
| JP | 09-015981 | 1/1997 |
| JP | 2001-083806 | 3/2001 |

* cited by examiner

*Primary Examiner*—Hoang Ngo

(57) ABSTRACT

A liquid-development electrophotographic apparatus forms on a toner-image-bearing body a plurality of color images developed by a plurality of developing units, one for each color, that use liquid toner. One or more carrier-removing units for removing excessive carrier from a toner layer that forms a toner image are disposed downstream of each developing unit and upstream of the next developing unit disposed upstream of the former developing unit with respect to a process progress direction. Each carrier-removing unit includes two or more conductive collection rollers to which a bias voltage is applied in such a direction as to press toner against the toner-image-bearing body and which is brought into contact with the toner-image-bearing body. The upstream roller is rotated in the same direction as the direction of surface movement of the toner-image-bearing body, whereas the downstream roller is rotated in the opposite direction. The result is that influence of carrier on the already transferred image is suppressed, and hence occurrences of irregular transfer of the images and occurrences of disturbance of the already transferred image are minimized.

10 Claims, 9 Drawing Sheets

Eighth Example of Carrier-Removing Unit

First Embodiment of The Present Invention

Second Embodiment of The Present Invention

First Example of Carrier-Removing Unit

Second Example of Carrier-Removing Unit

Third Example of Carrier-Removing Unit

Fourth Example of Carrier-Removing Unit

Fifth Example of Carrier-Removing Unit

Sixth Example of Carrier-Removing Unit

Seventh Example of Carrier-Removing Unit

Eighth Example of Carrier-Removing Unit

Ninth Example of Carrier-Removing Unit

Tenth Example of Carrier-Removing Unit

Eleventh Example of Carrier-Removing Unit

LIQUID DEVELOPMENT ELECTROPHOTOGRAPHIC DEVICE

TECHNICAL FIELD

The present invention relates to a liquid-development electrophotographic apparatus that uses liquid toner and, more particularly, to a liquid-development electrophotographic apparatus equipped with a carrier-removing unit adapted to remove excessive oil from a toner layer that forms an image on an intermediate transfer body.

BACKGROUND ART

FIG. 18 shows the overall construction of a liquid-development electrophotographic apparatus according to the conventional art. A plurality of developing units are provided on and around an intermediate transfer body, one for each of yellow, magenta, cyan, and black colors. Each developing unit includes a photosensitive drum (photosensitive body) 11–14 and a developing roller.

The developing roller, which is biased to a predetermined voltage so as to generate an electric field between the developing roller and the photosensitive drum 11–14, causes toner to adhere to an exposed region on the photosensitive drum 11–14 in accordance with the electric field, and develops an electrostatic latent image on the photosensitive drum 11–14, thereby forming a visible image. Liquid toner is fed to the developing roller from a toner reservoir. The liquid toner is thereby applied onto the developing roller to a predetermined layer thickness.

The intermediate transfer body transfers to itself toner adhering to the photosensitive drums 11 to 14, in accordance with the electric field between the intermediate transfer body and the respective photosensitive drums 11–14. A total of four color images developed on the respective photosensitive drums 11 to 14 are thereby superposed on the intermediate transfer body in sequence while the intermediate transfer body makes a single rotation, thereby forming a multicolor image. From these four color images thus superposed on the intermediate transfer body, carrier liquid is removed by means of one of more carrier-removing units 15. The image formed from liquid toner on the intermediate transfer body contains carrier liquid; conventionally, all the carrier-removing units for removing this carrier oil are located downstream of the position where superposition of the plural color images is completed, and the carriers contained in the images of four colors, for example, are collected simultaneously. Notably, each carrier-removing unit 15 includes a roller or a belt which is equipped with collecting means for collecting oil, and bias applying means for applying a bias voltage to the carrier-removing unit 15 in such a direction as to press the respective color image against the intermediate transfer body, and which is brought into contact with the intermediate transfer body to remove excessive carrier from a toner layer formed on the intermediate transfer body. Then, at a contact zone where the four-color image meets a printing medium, the four-color image is transferred to the printing medium by use of a pressure roller, whereupon the transferred four-color image is fixed while passing through a fixing unit.

Carrier solvent in liquid development serves not only to prevent toner particles of around 1 $\mu$m from scattering, but also to assist in uniformly dispersing the toner particles in a charged state; particularly, in development and electrostatic transfer steps, the carrier solvent also behaves as a bridge so that toner particles can easily move under the influence of an electric field.

Carrier solvent in a liquid-development printer process is a component that is essential as the process progresses from preservation of toner, to conveyance of toner to form a toner layer, to development of toner, and finally to electrostatic transfer of toner. Subsequent to the fixing step in which the image is fixed to a paper medium, however, the carrier solvent is not necessary. In the case of liquid-developer toner employing a nonvolatile carrier solvent, the carrier solvent cannot be volatilized while the toner is heated to melt, and therefore the carrier solvent would retard build-up of adhesion of the melted toner to a paper medium, particularly during the fixing of toner and during the melting and transfer of toner. As a result, quality of the image transferred and fixed to the paper medium and adherence of the melted toner occasionally fail to be fully satisfactory.

Thus, in the case of the nonvolatile carrier solvent, carrier (nonvolatile liquid) on the intermediate transfer body, etc. must be removed and collected before the formed image is transferred and fixed to the medium (printing material). In the conventional apparatus illustrated in FIG. 18, the carrier-removing units 15 are disposed downstream of the position where superposition of the plural color images is completed, and the carriers contained in the images of four colors, for example, are collected simultaneously. In this structure, since the total amount of carrier existing on the intermediate transfer body would increase with the progress of superposition of the color images, transfer of the image from the individual photosensitive drum to the intermediate transfer body would become progressively difficult. Consequently setting up conditions for each developing unit would be necessary, and mistransfer of image or disturbance of the already formed image would be likely to occur. Further, simultaneous removal of carriers for the four color images is not performed to a sufficient degree, because cohesion of toner progresses insufficiently.

In addition, a method for removal/collection of carrier (nonvolatile liquid) on the intermediate transfer body, etc. is known. In this known method, a conductive or semiconductive collection roller to which a bias voltage is applied in such a direction as to press toner against a toner-bearing object is disposed in a confronting relation with the toner-bearing object, and carrier adhering to the collection roller is collected by means of a blade, for example. For this purpose, a highly efficient carrier removing technique is known in which the collection roller is rotated in such a manner that its surface moves in a direction opposite that of surface movement of the intermediate transfer body (hereinafter also called reverse-rotation). However, this reverse-rotation technique is acknowledged to exert considerable stress on the toner and hence be likely to impair the image.

In order to maintain image quality while collecting carrier by bringing a reverse-rotating roller, which is high in carrier collection efficiency, into contact with a toner-bearing body such as an intermediate transfer body, a shear force generated in the toner by the reverse-rotating roller must be smaller than the degree of cohesion of toner resulting from application of a bias voltage. Increasing the temperature/bias voltage is effective for enhancing cohesion for toner; meanwhile, effective measures to minimize the shear force occurring in the toner include reducing the contact force between the collection roller and the toner bearing body, smoothing the roller surface, and reducing the frictional resistance between the roller and the toner layer.

Further, the conventional technology encounters the following problems. In a liquid-development electrophotographic apparatus using liquid toner, when a roller or belt for collecting excessive carrier is brought into contact with an image-bearing body such as an intermediate transfer body while the roller or belt is stopped, contact marks (nip marks) are left on the roller or belt. When removal of carrier takes place in such a state, image quality is adversely affected. Consequently, preferably the roller or belt and the image-bearing body assume an out-of-contact posture while the apparatus is stopped or on standby.

However, when the roller or belt is brought into contact with the image-bearing body while a bias voltage is applied to the roller or belt, discharge would occur with respect to the image-bearing body before the roller or belt comes into contact with the image-bearing body, in view that the bias voltage for pressing toner against the image-bearing body is as high as more than 1 KV. Accordingly, the discharge may lead to malfunction of the apparatus and formation of pinholes on the surface of the roller or belt and the surface of the image-bearing body.

Furthermore, in the case of a liquid-development electrophotographic apparatus equipped with a plurality of carrier-removing units, when the individual carrier-removing units are simultaneously biased to high voltage, the liquid-development electrophotographic apparatus will occasionally malfunction as a result of noise arising at that time.

SUMMARY OF THE INVENTION

In view of the foregoing circumstances, an object of the present invention is to arrange a plurality of carrier-removing units in an optimum manner in order to retard influence of carrier on the already transferred image to thereby minimize the occurrence of irregular transfer of image and disturbance of the already transferred image.

Another object of the present invention is to provide not only a high-quality printed material whose image quality is maintained even though removal of carrier takes place, but also a liquid-development electrophotographic apparatus which is free from malfunction stemming from noise.

A liquid-development electrophotographic apparatus according to the present invention forms on an image-bearing body a plurality of color images that are developed by a plurality of developing units, one for each color, that use liquid toner. One or more carrier units for removing excessive carrier from a toner layer that forms a toner image on the image-bearing body are located downstream of each developing unit and upstream of a succeeding developing unit disposed on a downstream side of each developing unit with respect to a process progress direction.

The carrier-removing unit includes two or more conductive or semiconductive collection rollers to which a bias voltage is applied in such a direction as to press toner against the image-bearing body and which are adapted to be brought into contact with the image-bearing body; and an upstream one of the collection rollers is rotated in the same direction as the direction of surface movement of the image-bearing body, whereas a downstream one of the collection rollers is rotated in the opposite direction.

The carrier-removing unit includes a conductive or semiconductive collection roller to which a bias voltage is applied in such a direction as to press toner against the image-bearing body and which is adapted to be brought into contact with the image-bearing body and adapted to be rotated in a direction opposite that of surface movement of the image-bearing body; the collection roller is equipped with carrier collection means; the carrier-removing unit further includes a conductive or semiconductive blade to which a bias voltage is applied in such a direction as to press toner against the image-bearing body and which is disposed upstream of the collection roller with respect to the process progress direction, and is disposed in contact with or separated by a very small gap from the image-bearing body under such a degree of pressure and elasticity as not to impair the images; and a distal end of the blade is disposed in the vicinity of a nip zone of the collection roller, so that the blade assumes such an angle with respect to the image-bearing body as to receive toner.

The carrier-removing unit includes at least two conductive or semiconductive collection rollers to which a bias voltage is applied in such a direction as to press toner against the image-bearing body, and a conductive or semiconductive belt wound on the collection rollers; the belt is adapted to be rotated in a direction opposite that of surface movement of the image-bearing body; and an upstream one of the conductive or semiconductive collection rollers is disposed in the vicinity of the image-bearing body with an very small gap so that the belt assumes such an angle with respect to the image-bearing body as to receive the toner.

The carrier-removing unit includes a conductive or semiconductive collection roller to which a bias voltage is applied in such a direction as to press the toner against the image-bearing body and which is adapted to be rotated in a direction opposite that of surface movement of the image-bearing body; and the carrier-removing unit further includes a corotron or scorotron device to which a bias voltage is applied in such a direction as to press the toner against the image-bearing body and which is disposed upstream of the carrier collection roller.

The apparatus further comprises a heat generating unit for increasing the toner temperature of the toner image formed on the image-bearing body to a temperature near or higher than a resin softening temperature from the time the toner image is transferred to the image-bearing body until the time the toner image arrives at the carrier-removing unit, and a control unit for maintaining the temperature of the toner constant; and the carrier-removing unit further includes a conductive or semiconductive collection roller which is brought into contact with the image-bearing body and is rotated in a direction opposite that of surface movement of the image-bearing body, wherein a bias voltage is applied to the collection roller in a direction so as to press the toner against the image-bearing body, and the collection roller has such a degree of elasticity and surface roughness that resin cohered by the bias voltage is allowed to pass without impairing the image.

The carrier-removing unit includes a heat generating unit for increasing the toner temperature of the toner image formed on the image-bearing body to a temperature near or higher than a resin softening temperature from the time the toner image is transferred to the image-bearing body until the time the toner image arrives at the carrier-removing unit, and a control unit for maintaining the temperature of the toner constant; and the carrier-removing unit further includes a first roller to which a bias voltage is applied in a direction so as to press the toner against the image-bearing body and which has such a degree of elasticity that resin cohered by the bias voltage is allowed to pass without impairing the image, a second roller disposed at a lower level than the first roller and out of contact with the image-bearing body, and a conductive belt wound on the first and second rollers and adapted to be rotated in a direction opposite that of surface movement of the image-bearing body.

The carrier-removing unit assumes the form of a roller or belt adapted to be in contact with the image-bearing body and equipped with bias applying means for applying a bias voltage in a direction so as to press the respective color image against the image-bearing body, and collecting means for collecting the carrier; and the carrier-removing unit includes drive means for moving the roller or belt toward and away from the image-bearing body between its in-contact position and its retracted position, and control means for not only adjusting the timing of movement of the roller or belt between the in-contact position and the retracted position, which movement is caused by the drive means, but also adjusting the timing of application of the bias voltage.

BEST MODE FOR CARRYING OUT THE INVENTION

Figure 1:
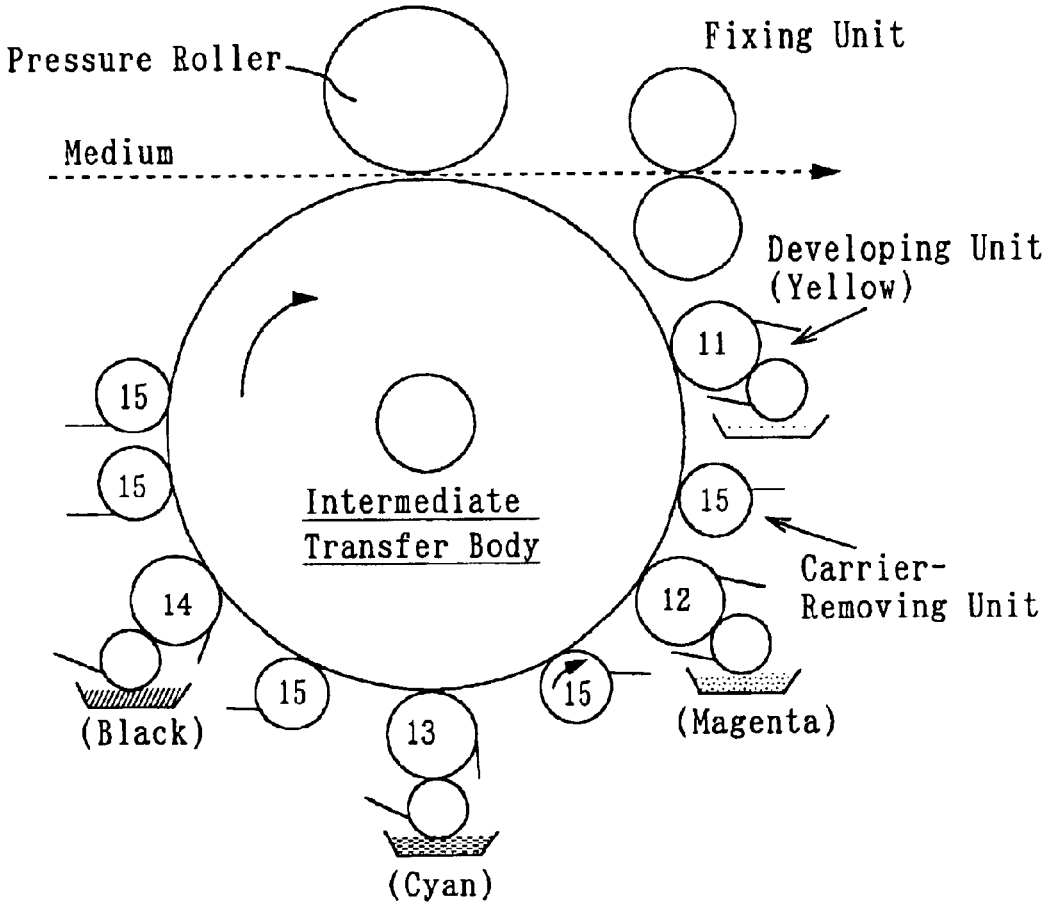
FIG. 1 is a diagram showing a first embodiment of a liquid-development electrophotographic apparatus according to the present invention.

The present invention will now be described in detail by reference to embodiments. FIG. 1 is a diagram showing a first embodiment of a liquid-development electrophotographic apparatus of the present invention.

A plurality of developing units are provided, one for each of yellow, magenta, cyan, and black colors. These developing units include photosensitive drums (photosensitive bodies) 11 to 14, respectively, and a charger (not shown) for electrifying the photosensitive drums 11 to 14 to approximately 700 V. Exposure of each of the electrically charged photosensitive drums 11 to 14 takes place on the basis of image data by means of, for example, LEDs or laser light. An electrostatic latent image whose exposed portion has approximately 100 V of potential is thereby formed on each of the photosensitive drums 11 to 14. Further, an unillustrated discharger is provided for discharging the remaining potential on the photosensitive drums 11 to 14.

A developing roller of each of the developing units is biased to a predetermined voltage of approximately 400 V to 600 V to thereby apply a positively charged toner to the respective photosensitive drum 11 to 14 in accordance with an electric field between the developing roller and the corresponding photosensitive drum. This causes the toner to adhere to the exposed portion of the latent image on each of the photosensitive drums 11 to 14 charged to approximately 100 V, whereupon the electrostatic latent image on each of the photosensitive drums 11 to 14 is developed to form a visible image. As shown in the figure, a liquid toner having a toner viscosity of 400 to 4000 mPa S and a carrier viscosity of 20 to 500 cSt, preferably 100 cSt, is applied directly from a toner tank to the developing roller. This enables application of the liquid toner onto the developing roller to form a toner layer to a predetermined thickness (e.g., 4 to 10 $\mu$m). Alternatively, a toner application roller assembly including one or more rollers may be provided for every color toner in order to convey the liquid toner from the toner tank while spreading the liquid toner into a thin layer.

An intermediate transfer body assumes the form of a roller as shown in FIG. 1 and serves to transfer to itself toner adhering to each of the photosensitive drums 11 to 14 in accordance with an electric field between the intermediate transfer body and the respective photosensitive drum 11 to 14. The intermediate transfer body transfers to itself firstly yellow toner, for example, which adheres to the first photosensitive drum 11; then magenta toner, for example, which adheres to the second photosensitive drum 12; then cyan toner, for example, which adheres to the third photosensitive drum 13; and finally black toner, for example, which adheres to the fourth photosensitive drum 14. These toner images of four colors developed on the first to fourth photosensitive drums 11 to 14 are superposed in sequence on the intermediate transfer body while the intermediate transfer body makes a single complete rotation, thereby forming a multicolor image. An unillustrated cleaner blade is brought into contact with the intermediate transfer body at a proper timing to remove the remaining toner and prewet liquid which remains on the intermediate transfer body.

Meanwhile, carrier liquid is removed from a toner layer that forms the color images superposed on the intermediate transfer body means of a plurality of carrier-removing units. The image formed on the intermediate transfer body contains carrier liquid, and the carrier-removing units 15 serve to remove this carrier oil from the liquid toner. Of these carrier-removing units 15 of the present invention, one or more carrier-removing units 15 are disposed downstream of each of the developing units, which are arranged sequentially in a direction of progress of a developing process, and upstream of the next developing unit. In the illustrated example, a single carrier-removing unit is disposed between each pair of neighboring developing units and, for finishing the removal, two carrier-removing units 15 are disposed immediately downstream of the last developing unit (i.e., upstream of the first developing unit). Alternatively, such carrier-removing units may be provided not only on the intermediate transfer body, but also on image-bearing bodies, including the photosensitive drums.

Accordingly, carrier can be removed before the next image is superposed over the previously developed image or images. As a result, the amount of carrier present in the toner image on the intermediate transfer body does not unnecessarily increase even when the superposition of toner images progresses, and therefore, conditions do not have to be set for each developing unit, and mistransfer of image and disturbance of the already formed image do not occur. If installation space is limited, one or more carrier-removing units may be provided for every two developing units.

Subsequently, the four-color image is transferred to a printing medium as the image is pressed against the medium by a pressure roller at a contact zone where the image meets the medium, whereupon the transferred image is affixed by use of a fixing unit.

Figure 2:
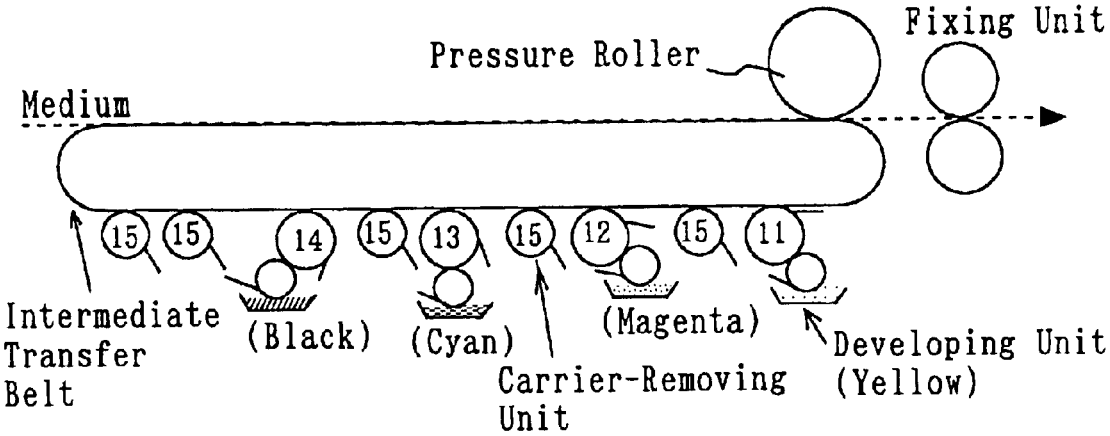
FIG. 2 is a diagram showing a second embodiment of a liquid-development electrophotographic apparatus according to the present invention.

FIG. 2 is a diagram showing a second embodiment of a liquid-development electrophotographic apparatus of the present invention. Unlike the first embodiment, whose intermediate transfer body assumes the form of a roller, the second embodiment employs an intermediate transfer body assuming the form of a belt, as shown in the figure. Carrier liquid is removed from the images of four colors superposed on the intermediate transfer body in belt form, by means of a plurality of carrier-removing units 15 that are provided in basically the same manner as the first embodiment. Namely, one or more carrier-removing units 15 are disposed downstream of each of the developing rollers, which are arranged in sequence in a direction of progress of a multicolor developing process, and upstream of the next developing unit. Alternatively, one or more carrier-removing units 15 may be provided for every two developing units.

Figure 3:
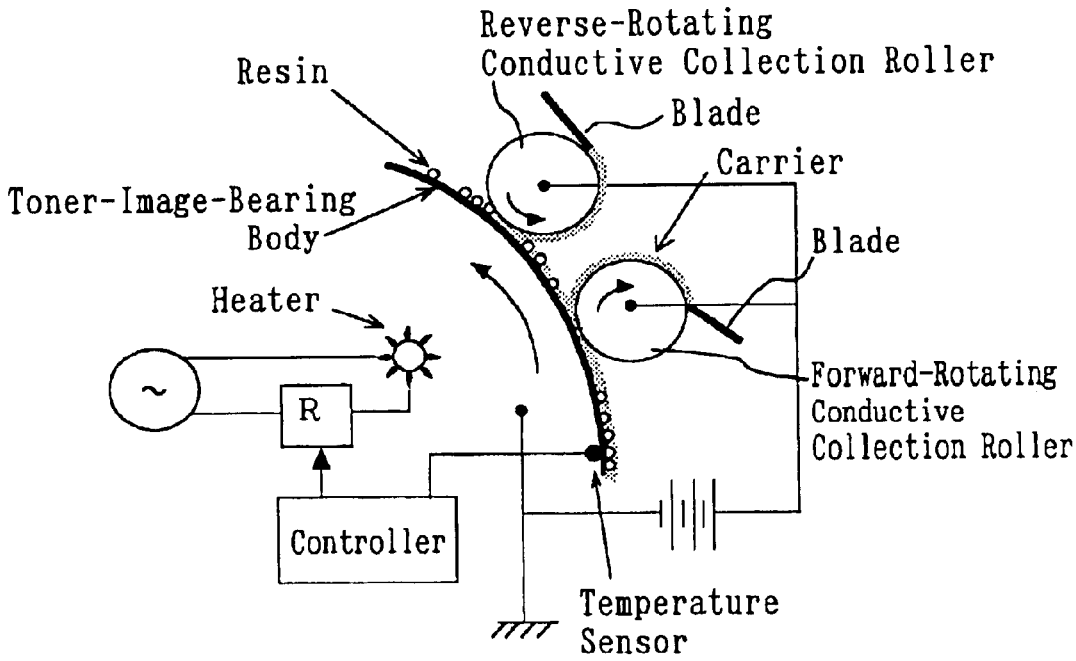
FIG. 3 is a diagram showing a first example of a carrier-removing unit to be used in the liquid-development electrophotographic apparatus embodying the present invention.

FIG. 3 is a diagram of a first example of a carrier-removing unit to be used in the liquid-development electrophotographic apparatus of the present invention. At least two conductive or semiconductive collection rollers to which a bias voltage is applied in such a direction as to press toner against a toner-image-bearing body, such as an intermediate transfer roller, are brought into contact with the toner-image-bearing body. The collection roller disposed upstream with respect to the direction of progress of a developing process is rotated (forward-rotated) in such a manner that its surface moves in the same direction as that of the intermediate transfer roller at a contact zone where the surfaces of these two rollers meet, whereas the downstream roller is rotated in the opposite direction. Further, each of the collection rollers is equipped with a carrier collector, such as a blade.

There are further provided a heater for heating toner to a temperature near or higher than a softening temperature of resin contained in the toner, and a controller for maintaining a constant toner temperature. The illustrated controller may be a device that controls a resistance R connected in series with the heater, on the basis of a temperature that is detected at the surface of the intermediate transfer roller by a temperature sensor.

If carrier is collected by means of a reverse-rotating roller, which is high in carrier collection efficiency, the formed image is prone to be impaired by the force received from the reverse-rotating roller. This is because the formed image receives an undue force from the reserve-rotating roller before cohesion of resin becomes sufficiently strong.

The above-described image impairment can be prevented by causing the formed image to temporarily cohere before carrier is collected by the reverse-rotating roller. Further, the carrier collection efficiency of the reserve-rotating roller can be improved by the advance resin cohesion. Further, toner cohesion can be enhanced by heating toner to a temperature near or higher than a softening temperature of resin.

Figure 4:
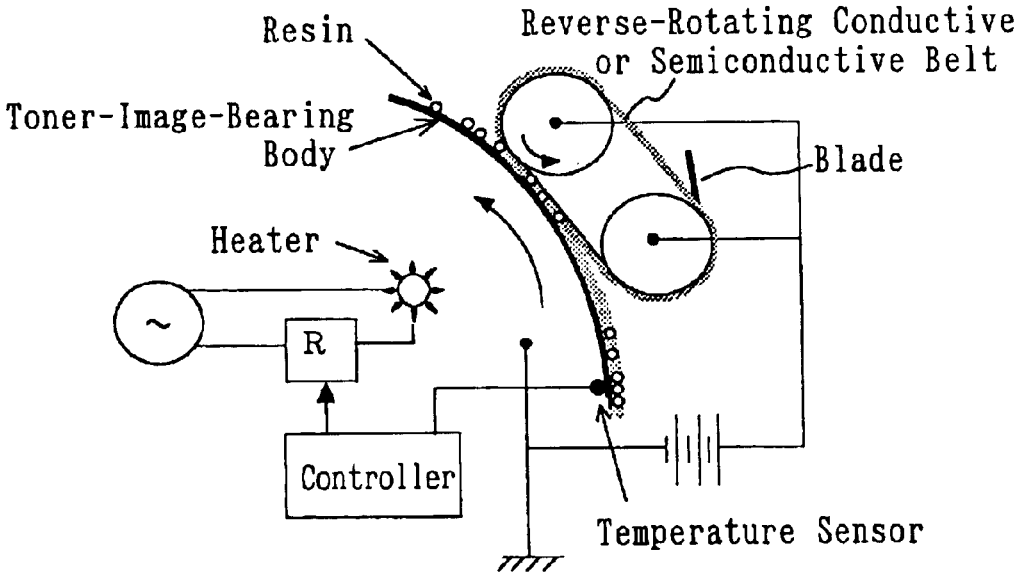
FIG. 4 is a diagram showing a second example of a carrier-removing unit to be used in the liquid-development electrophotographic apparatus embodying the present invention.

FIG. 4 is a diagram showing a second example of a carrier-removing unit to be used in the liquid-development electrophotographic apparatus of the present invention. A conductive or semiconductive belt is wound onto at least two conductive or semiconductive collection rollers, and a bias voltage is applied in a direction so as to press toner against a toner-image-bearing body, such as an intermediate transfer roller. The belt is rotated in a direction opposite that of surface movement of the intermediate transfer roller. The upstream collection roller is disposed in the vicinity of the intermediate transfer roller with a very small gap, in such a manner that the belt assumes an angle with respect to the intermediate transfer roller so as to receive toner. Further, a carrier collector such as a blade is provided on the conductive belt.

Figure 5:
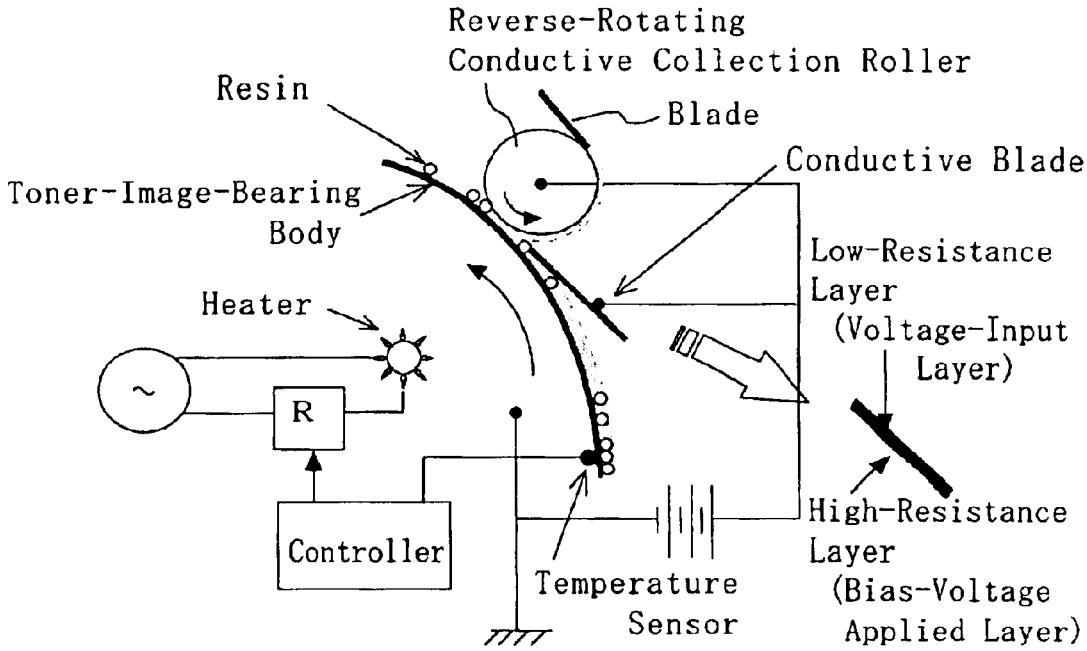
FIG. 5 is a diagram showing a third example of a carrier-removing unit to be used in the liquid-development electrophotographic apparatus embodying the present invention.

FIG. 5 is a diagram showing a third example of a carrier-removing unit to be used in the liquid-development electrophotographic apparatus of the present invention. A conductive or semiconductive collection roller, to which a bias voltage is applied in a direction so as to press toner against a toner-image-bearing body such as an intermediate transfer roller, is brought into contact with the toner-image-bearing body, while a conductive or semiconductive blade, to which a bias voltage is applied in a direction so as to press toner against the toner-image-bearing body, is disposed upstream of the collection roller with respect to the direction of progress of a developing process. The conductive or semiconductive blade has such a degree of pressure and elasticity as not to cause image impairment and is disposed in contact with or separated by a very small gap from the toner-image-bearing body. A leading end of the conductive or semiconductive blade is disposed in the vicinity of a nip zone of the conductive or semiconductive collection roller at an angle so as to receive the toner.

As shown on an enlarged scale at the right side of the figure, the conductive or semiconductive blade has a double-layer structure formed of a low-resistance layer and a high-resistance layer; a uniform electric field can be applied to the blade by applying a voltage from the low-resistance layer.

Figure 6:
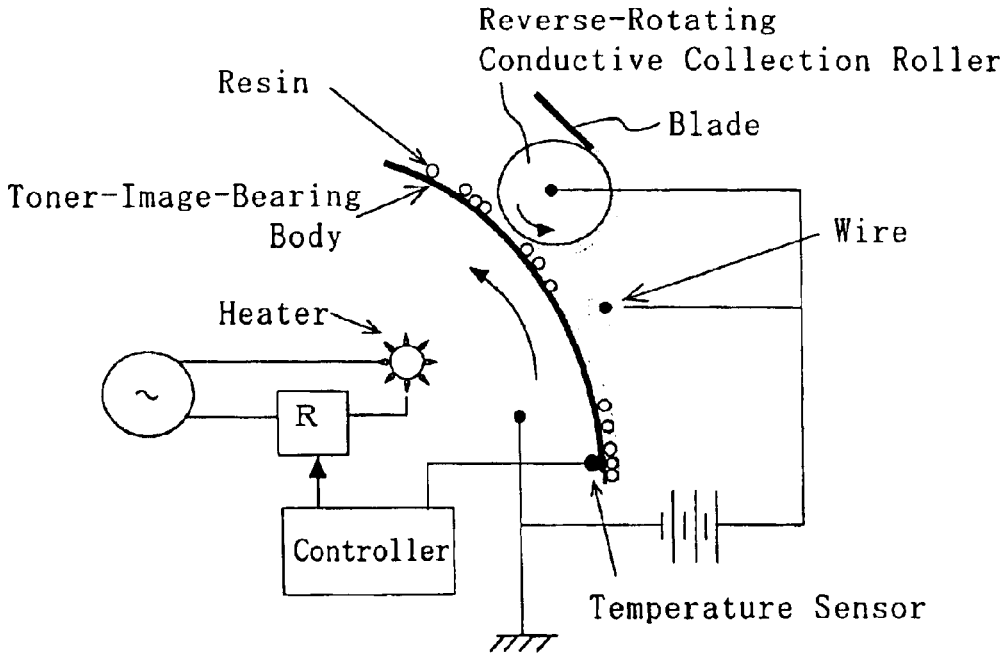
FIG. 6 is a diagram showing a fourth example of a carrier-removing unit to be used in the liquid-development electrophotographic apparatus embodying the present invention.

FIG. 6 is a diagram showing a fourth example of a carrier-removing unit to be used in the electrophotographic apparatus of the present invention. A conductive or semiconductive collection roller to which a bias voltage is applied in a direction so as to press toner against a toner-image-bearing body, such as an intermediate transfer roller, is brought into contact with the toner-image-bearing body. Further, a corotron device or a corotron device (known as electric chargers; stated in short, a corotron device is in the form of only a wire, and a scorotron device includes, in addition to such a wire, a grid), to which a bias voltage is applied in a direction so as to press toner against the toner-image-bearing body, is disposed upstream of the collection roller with respect to the direction of progress of a multicolor developing process. Further, the conductive or semiconductive collection roller is equipped with a carrier collector such as a blade.

The conductive or semiconductive collection roller, the conductive or semiconductive blade (FIG. 5), the conductive or semiconductive belt (FIG. 4), and the toner-image-bearing body surface have each a resistance value of about 1E5 to 1E9 Ω ($10^5$ to $10^9$ Ω); and a bias voltage to be applied is set to a high voltage of 1 KV or higher, preferably about 2 to 4 KV, whereas a current is set to about 200 μA to 3 mA.

Figure 7:
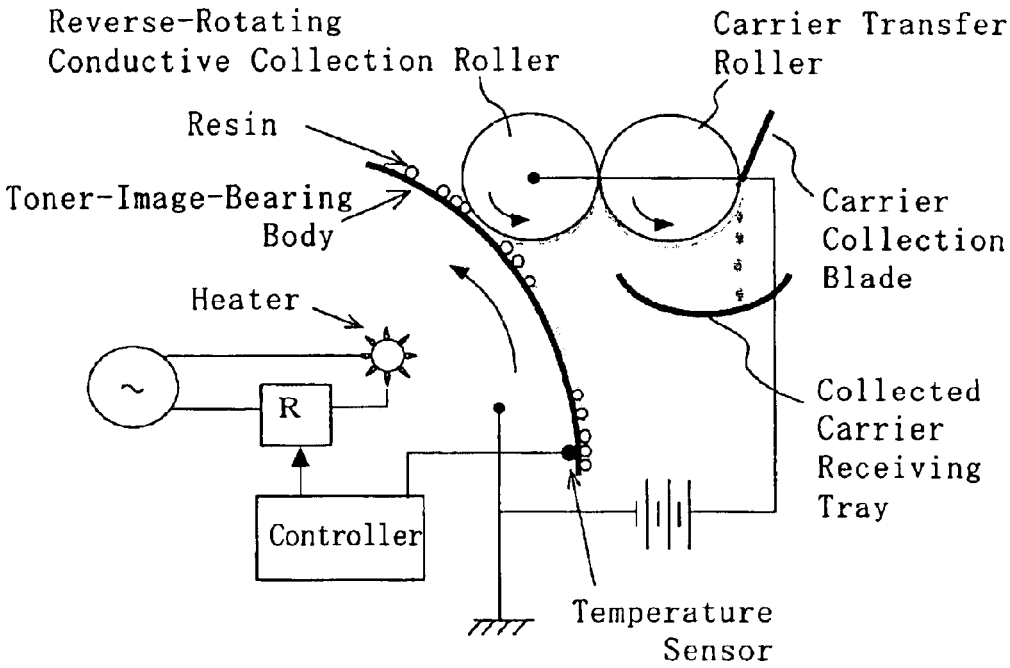
FIG. 7 is a diagram showing a fifth example of a carrier-removing unit to be used in the liquid-development electrophotographic apparatus embodying the present invention.

FIG. 7 is a diagram showing a fifth example of a carrier-removing unit to be used in the liquid-development electrophotographic apparatus of the present invention. The carrier-removing unit of the present example includes a heater for increasing the temperature of toner of the image formed on a toner-image-bearing body, such as an intermediate transfer roller, to a temperature near or higher than a softening temperature of resin from the time the image is transferred to the intermediate transfer roller until the time the image arrives at the carrier-removing unit; and a controller for maintaining the increased toner temperature constant. Further, a conductive or semiconductive collection roller is disposed in contact with the intermediate transfer roller and adapted to be rotated (rotated in reverse) in such a manner that its surface moves in the opposite direction with respect to the surface of the intermediate transfer roller at a contact zone where the surfaces of these rollers meet. A bias voltage is applied to the conductive or semiconductive collection roller in such a direction as to press toner against the intermediate transfer roller, and the conductive or semiconductive collection roller has such degree of elasticity and surface roughness that resin cohered by the applied bias voltage is allowed to pass without impairing the image.

The conductive or semiconductive collection roller may be composed of a conductive foamed elastic substrate and a conductive tube which covers the elastic substrate. In this case, the resulting collection roller can have not only such a degree of elasticity and surface roughness that the image affixed by the applied bias voltage is allowed to pass without being impaired, but also a conductivity of about 1E5 to 1E9 Ω.

Further, the conductive or semiconductive collection roller may be composed of a conductive foamed elastic layer and a conductive tube which covers the elastic layer and serves as a surface layer portion. The elastic layer is formed of foamed urethane, foamed EPDM, foamed silicone rubber, or foamed hydrin rubber, and is imparted with conductivity. The surface layer is formed through extrusion of PFA resin, ETFE resin, or nylon resin in such a manner that the surface layer has an electrical resistance and a surface roughness of Rz 5 μm or less. The resistance value of the conductive tube, which serves as the surface layer, is set to a value equal to or higher than that of the conductive foamed elastic substrate, which serves as the inner layer. This suppresses a current flowing in the surface layer portion in the layer direction and allows a current to flow in the radial direction of the roller. Further, the rubber hardness and the tube thickness can be set in such a manner that the roller hardness falls within the range of 30° to 60° (Asker C).

The speed of the reverse-rotation of the conductive or semiconductive collection roller is preferably equal to the speed of the intermediate transfer roller or, for example, about one to five times the speed of the intermediate transfer roller.

Further, there may be provided one or more carrier transfer rollers which are brought into contact with the conductive or semiconductive collection roller and are adapted to be rotated in such a manner that their surfaces move in a direction opposite the direction of surface movement of the collection roller at a contact zone where the surfaces of these rollers meet. The carrier transfer roller is equipped with a carrier collection blade in contact with the carrier transfer roller, and a collected carrier receiving tray disposed beneath the blade.

Figure 8:
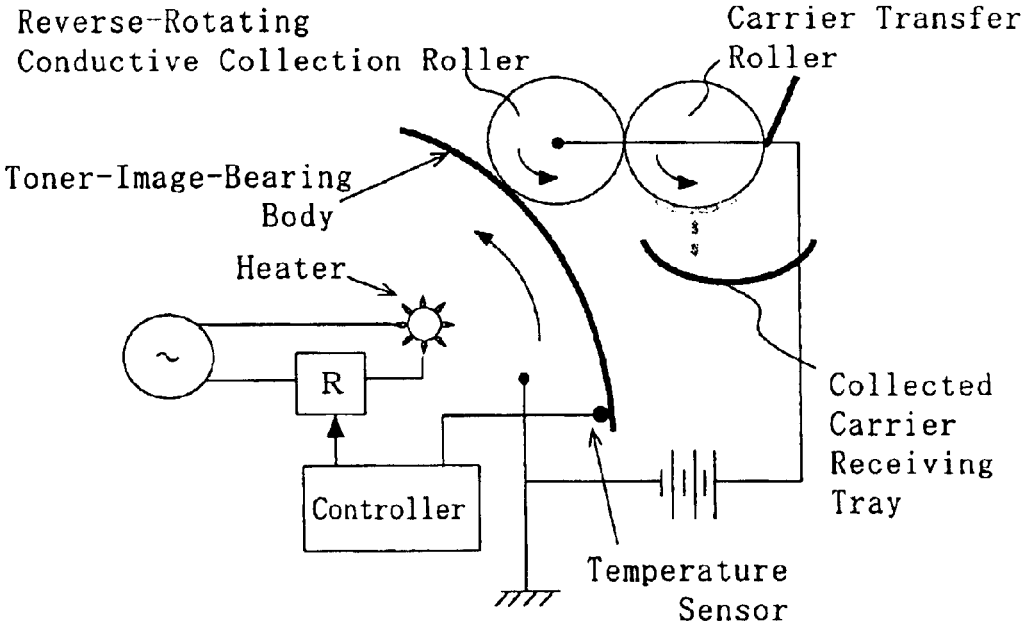
FIG. 8 is a diagram showing a sixth example of a carrier-removing unit to be used in the liquid-development electrophotographic apparatus embodying the present invention.

FIG. 8 is a diagram showing an eighth example of a carrier-removing unit to be used in the liquid-development electrophotographic apparatus of the present invention. This diagram is an explanatory view illustrating the operation of the carrier-removing unit while the apparatus is stopped; and the carrier-removing unit itself is identical in construction with that of the fifth example. Generally, carrier on a collection roller is removed from the roller by means of a blade. However, while the apparatus is stopped, a very small amount of carrier remaining on the roller end portion and roller surface gathers to a lower portion of the collection roller by gravity and finally drops by gravity. Consequently, the collected carrier receiving tray must be located so as to cover the underside of the lowermost portion of the roller. For this reason, FIG. 8 depicts an example in which the collected carrier receiving tray is located so as to cover the underside of the lowermost portion of the roller.

Figure 9:
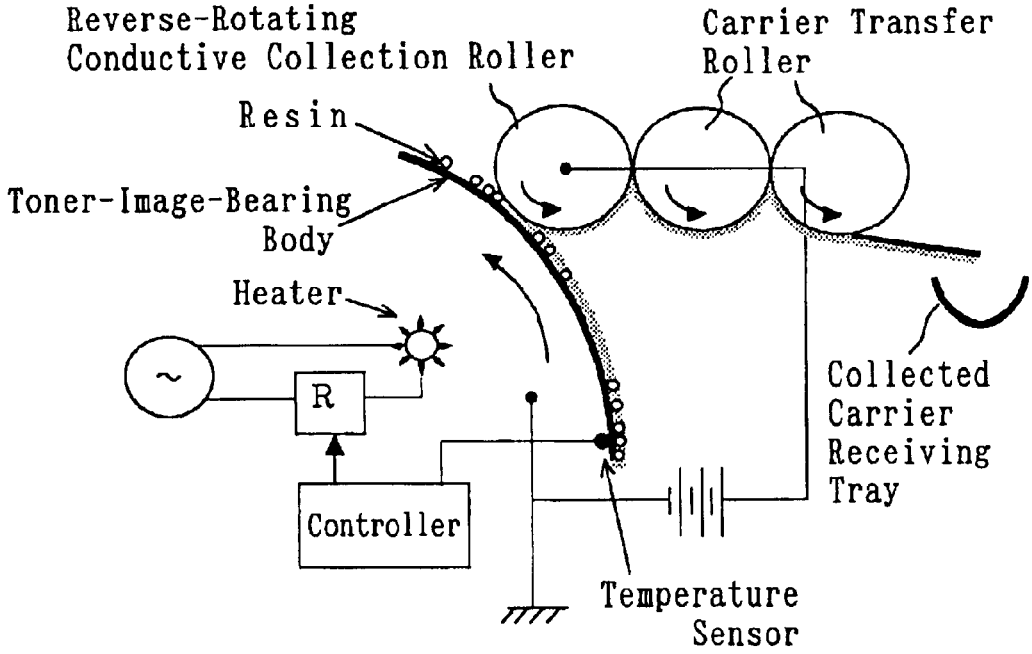
FIG. 9 is a diagram showing a seventh example of a carrier-removing unit to be used in the liquid-development electrophotographic apparatus embodying the present invention.

FIG. 9 is a diagram showing a seventh example of a carrier-removing unit to be used in the liquid-development electrophotographic apparatus of the present invention. Securing of sufficient space for installation of a collected carrier receiving tray may be impossible, depending on the relation in which a conductive or semiconductive collection roller is brought into contact with a toner-image-bearing body, such as an intermediate transfer roller. Consequently, a blade is brought into contact with the roller in the vicinity of its lowermost portion in order that the carrier gathered by gravity during stoppage of the apparatus flows along the blade down to its lowermost portion so as to complete collection. As a result, cleaning the roller end becomes unnecessary, as does placement of a collected carrier receiving tray beneath the roller. Further, even when bringing a blade into contact with the lowermost portion of the conductive or semiconductive collection roller itself is difficult, oil can be collected at any location that is free of potential problems in placing the blade, subject to provision of a plurality of reverse-rotating carrier transfer rollers, as shown in FIG. 9, or conveyance of carrier by use of a seamless belt.

Figure 10:
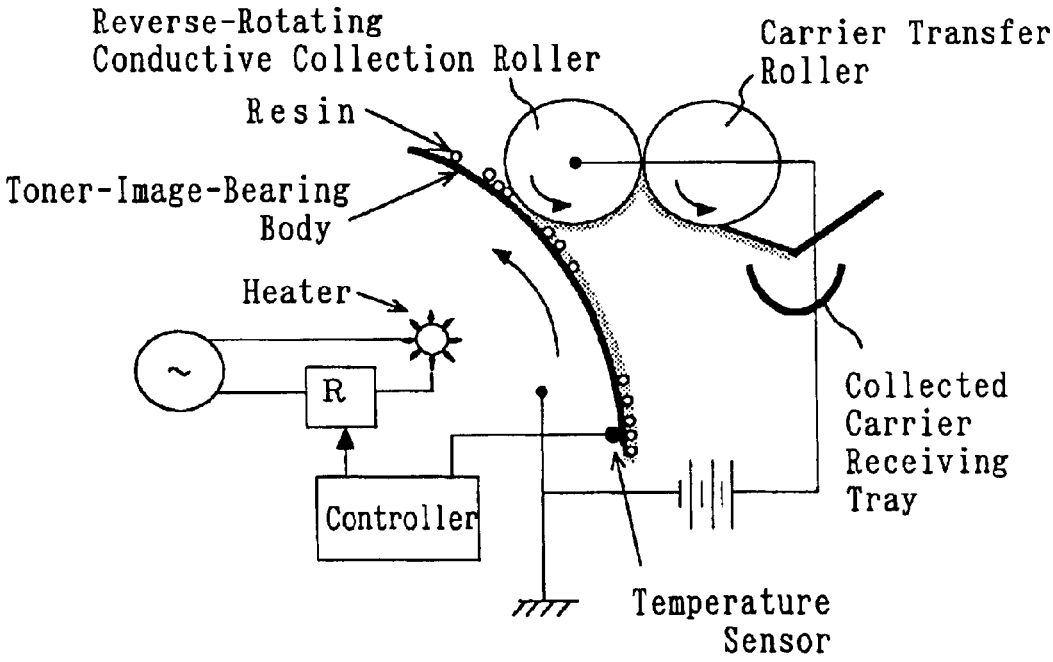
FIG. 10 is a diagram showing an eighth example of a carrier-removing unit to be used in the liquid-development electrophotographic apparatus embodying the present invention.

FIG. 10 is a diagram showing an eighth example of a carrier-removing unit to be used in the liquid-development electrophotographic apparatus of the present invention. As depicted in the figure, a bent blade is provided in such a manner that its lowermost angled portion is located above a collected carrier receiving tray; the bending of the blade is such that dammed carrier flows into the collected carrier receiving tray disposed at a position within a restricted installation zone.

Figure 11:
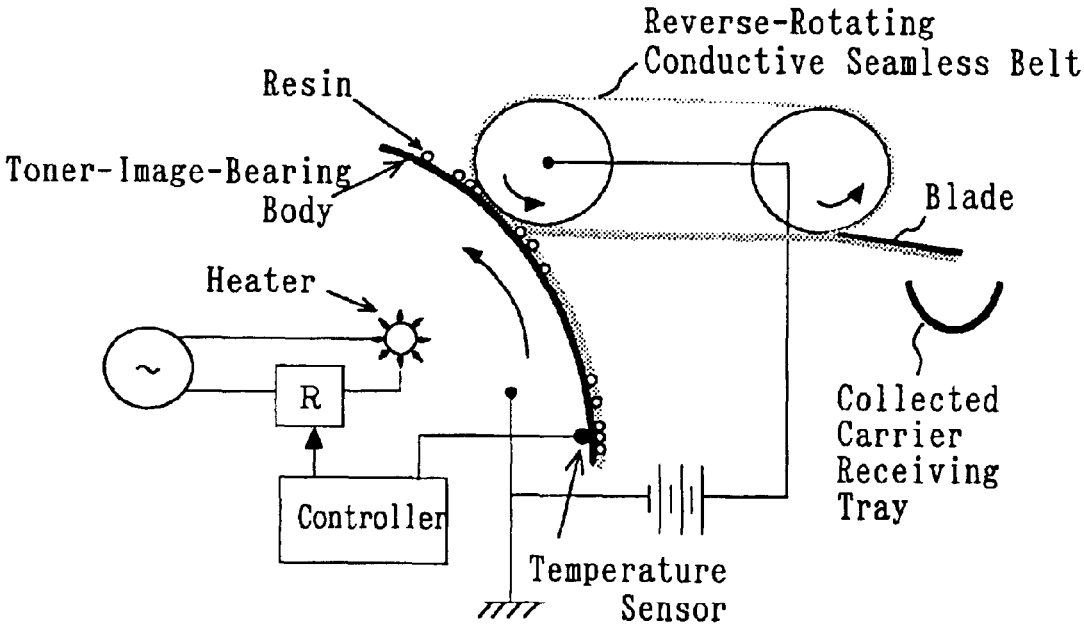
FIG. 11 is a diagram showing a ninth example of a carrier-removing unit to be used in the liquid-development electrophotographic apparatus embodying the present invention.

FIG. 11 is a diagram showing a ninth example of a carrier-removing unit to be used in the liquid-development electrophotographic apparatus of the present invention. In the present example, as in the foregoing examples, a heater and a controller for maintaining the temperature of the heater constant are provided. Further, the carrier-removing unit is equipped with a conductive seamless belt adapted to be rotated (rotated in reverse) in such a manner that its surface moves in a direction opposite the direction of surface movement of a toner-image-bearing body, such as an intermediate transfer roller, at a contact zone where the surfaces of the belt and roller meet. The seamless belt is wound between a roller to which a bias voltage is to be applied in a direction so as to press toner against the toner-image-bearing body and which has such a degree of elasticity that resin cohered by the bias voltage is allowed to pass without impairing the image, and another roller located at a lower level than the former roller without being in contact with the intermediate transfer roller. In addition, the carrier-removing unit is equipped with a blade for scraping carrier off the seamless belt, and a collected carrier receiving tray.

Figure 12:
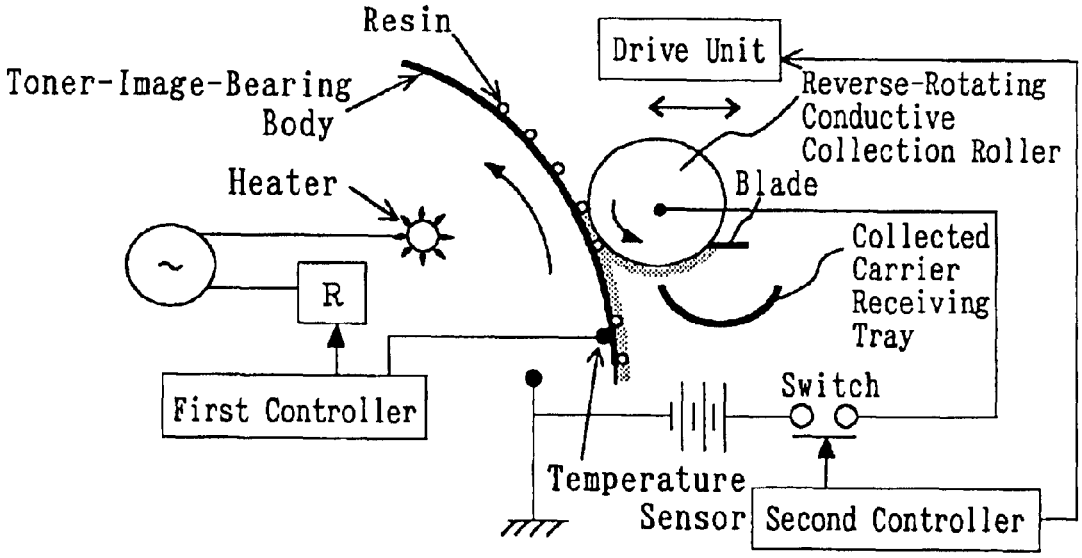
FIG. 12 is a diagram showing a tenth example of a carrier-removing unit to be used in the liquid-development electrophotographic apparatus embodying the present invention.

FIG. 12 is a diagram showing a tenth example of a carrier-removing unit to be used in the liquid-development electrophotographic apparatus of the present invention. In this figure, the carrier-removing unit to be used in the liquid-development electrophotographic apparatus using liquid toner includes at least one conductive or semiconductive roller to which a bias voltage is to be applied in such a direction as to press toner against a toner-image-bearing body, such as an intermediate transfer roller, and which is brought into contact with the toner-image-bearing body. The conductive collection roller is rotated (rotated in reverse) in such a manner that its surface rotates in a direction opposite that of surface movement of the toner-image-bearing body at a contact zone where the surfaces of these two rollers meet. Further, the conductive collection roller is equipped with a blade and a collected carrier receiving tray.

Furthermore, the carrier-removing unit is such that at least the conductive collection roller is moved toward and away from the toner-image-bearing body between its in-contact position and its retracted position by means of a drive device. Moreover, in the carrier-removing unit, the timing of movement of the conductive collection roller toward and away from the toner-image-bearing body between the in-contact position and the retracted position is controlled by a second controller; and the timing of application of the bias voltage in such a direction as to press toner against the toner-image-bearing body and the timing of stoppage of the bias voltage application are controlled by a switch.

At that time, the second controller may control the timing of movement of the individual carrier-removing unit toward and away from the toner-image-bearing body between the in-contact position and the retracted position, as well as the timing of the bias voltage application to the individual carrier-removing unit and the timing of stoppage of the bias voltage application to the individual carrier-removing unit, in such a manner that these timings are shifted among the individual carrier-removing units.

Further, the bias voltage to be applied to the carrier-removing unit may be applied in such a direction as to press toner against the toner-image-bearing body, or may be inverted in polarity and then applied in such a direction as to pull toner off the toner-image-bearing body.

Notably, the toner-image-bearing body is equipped with a heater for heating toner to a temperature near or higher than a softening temperature of resin contained in the toner, and a first controller for maintaining the temperature of the heater constant. The illustrated first controller controls a resistance R connected in series with the heater, on the basis of a temperature detected at the surface of the toner-image-bearing body by a temperature sensor.

Figure 13:
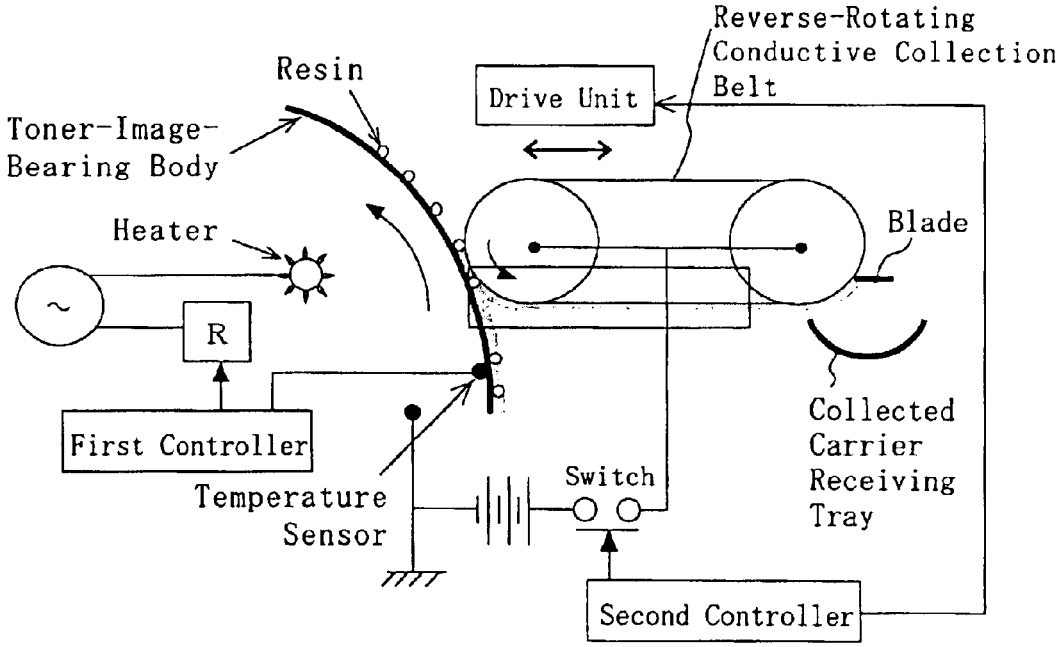
FIG. 13 is a diagram showing an eleventh example of a carrier-removing unit to be used in the liquid-development electrophotographic apparatus embodying the present invention.

FIG. 13 is a diagram showing an eleventh example of a carrier-removing unit to be used in the liquid-development electrophotographic apparatus of the present invention. The carrier-removing unit of the present example is identical with the carrier-removing unit illustrated in FIG. 12, except that a conductive or semiconductive collection belt is used in place of the conductive collection roller.

There is provided at least one conductive or semiconductive collection belt to which a bias voltage is to be applied in such a direction as to press toner against a toner-image-bearing body, such as an intermediate transfer roller, and which is brought into contact with the toner-image-bearing body. The conductive collection belt is rotated (rotated in reverse) in such a manner that its surface moves in a direction opposite that of surface movement of the toner-image-bearing body at a contact zone where these two surfaces meet. Further, the conductive collection belt is equipped with a blade and a collected carrier receiving tray. In addition, the carrier-removing unit causes at least the conductive collection belt to move toward and away from the toner-image-bearing body between its in-contact position and its retracted position, by means of a drive device.

As is obvious from the above description with reference to FIG. 3, the carrier collection efficiency can be increased by reversing the rotation direction of the conductive collection roller or belt. In such an event, however, the formed image is prone to be impaired by undue forces attributed to the conductive collection roller or belt. This is because, before cohesion of resin becomes sufficient, the formed image would receive undue forces from the conductive collection roller or belt.

Such image impairment can be prevented by causing the formed image to temporarily cohere before carrier is collected by the reverse-rotating roller or belt, and the carrier collection efficiency of the reverse-rotating roller can be improved through the advance resin cohesion. Further, cohesion of toner can be enhanced by heating the toner to a temperature near or higher than a softening temperature of resin. Therefore, a reserve-rotating conductive collection roller or belt does not necessarily have to be employed for each of a plurality of carrier-removing units.

Because a plurality of carrier-removing units are provided around the intermediate transfer body as described above with reference to FIGS. 1 and 2, a forward-rotating conductive collection roller or forward-revolving conductive collection belt can be employed for one or more of the plurality of carrier-removing units; the control described above with reference to FIGS. 12 and 13 can take place even for such one or more carrier-removing units. Namely, also in the case of the carrier-removing unit having the forward-rotating conductive collection roller or forward-revolving conductive collection belt, at least the conductive collection roller or belt is moved toward and away from the toner-image-bearing body between the in-contact position and the retracted position by means of the drive device. Further, in the case of the carrier-removing unit, not only can the timing of movement of the conductive collection roller or belt between the in-contact position and the retracted position be controlled, but also the timing of application of the bias voltage in a direction can be controlled so as to press toner against the toner-image-bearing body, along with the timing of stoppage of the bias voltage application.

Next, with reference to FIGS. 14 to 17 there will be described the control procedure of the timing of movement of the carrier-removing unit between the in-contact position and the retracted position by means of the drive device and the control procedure of both the timing of application of the bias voltage and the timing of stoppage of the bias voltage application, which control procedures are illustrated in FIGS. 12 and 13.

Figure 14:
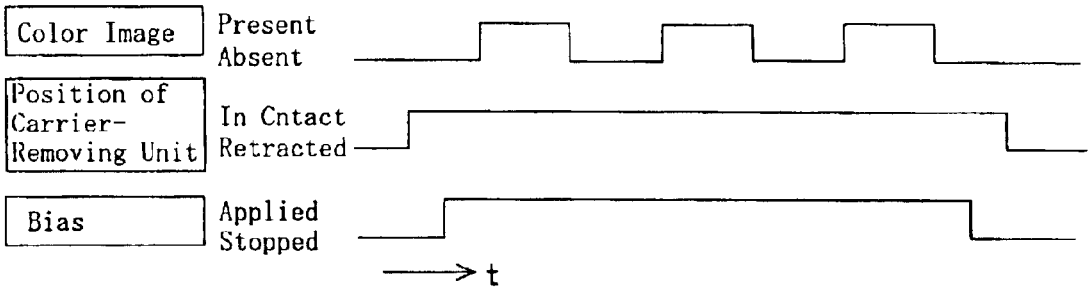
FIG. 14 is a timing chart showing a first example of timing control.

FIG. 14 is a timing chart showing a first example of the timing control. This figure shows the state of whether the color image is present or absent on the toner-image-bearing body (the intermediate transfer body) at the location of the carrier-removing unit, the state of whether the carrier-removing unit assumes the in-contact position or the retracted position, and the state of whether the bias voltage is applied or the bias voltage application is stopped, as the state of each kind changes with time (t) from left to right in the figure.

Firstly, at the leftmost position in the figure, the color image at the location of the carrier-removing unit is "absent," the carrier-removing unit is "retracted," and the bias voltage application is "stopped." As the color image approaches the location of the carrier-removing unit from this state as shown in the figure, the conductive collection roller (FIG. 12) or the conductive collection belt (FIG. 13) is brought into contact with the toner-image-bearing body before the color image arrives at the location of the carrier-removing unit, whereupon a bias voltage is applied to the conductive collection roller or belt in a direction to press toner against the image-bearing body. Then, when the color image has gone, the bias voltage application is stopped after the lapse of a predetermined time, whereupon the conductive collection roller or belt is retracted from the image-bearing body.

As a result of this control, the carrier-removing unit assumes the retracted position away from the image-bearing body while the apparatus is stopped or on standby. Further, a bias voltage is applied after the conductive collection or belt is brought into contact with the image-bearing body, and application of the bias voltage is stopped before the conductive collection roller or belt is retracted from the image-bearing body. Therefore, no discharging to the image-bearing body occurs; consequently, not only is the apparatus free of malfunction, but also the surface of the conductive collection roller or belt and the surface of the image-bearing body are free of formation of pinholes attributed to the discharging, whereby image quality is maintained.

Figure 15:
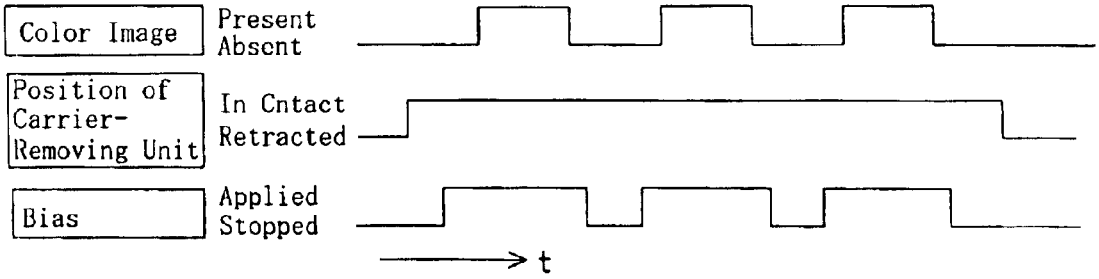
FIG. 15 is a timing chart showing a second example of timing control.

FIG. 15 is a timing chart showing a second example of the timing control. The second example differs from the above-described first example in that the bias voltage application is stopped at a non-image region. Namely, the bias voltage application is stopped after the lapse of a predetermined time from the arrival of a non-image region, and a bias voltage is applied a predetermined period of time earlier than the arrival of an image region. In the above-described first example, while the carrier-removing unit assumes the in-contact position, a bias voltage is continuously applied until a single succession of color image regions is finished. In contrast, because the bias voltage application is stopped at every arrival of a succeeding region void of color image even while the carrier-removing unit assumes the in-contact position, power consumption is reduced. Further, control of the bias voltage application takes place in accordance with the determination on whether a color image region is present or absent, which determination is made on the basis of analysis of printing data.

By virtue of this control, degradation of the conductive collation roller or belt and degradation of the image-bearing body by the effect of the applied bias voltage is minimized, because application of the bias voltage is stopped at the arrival of a non-image region for which application of the bias voltage application is unnecessary. This control also contributes to reduction of power consumption.

Figure 16:
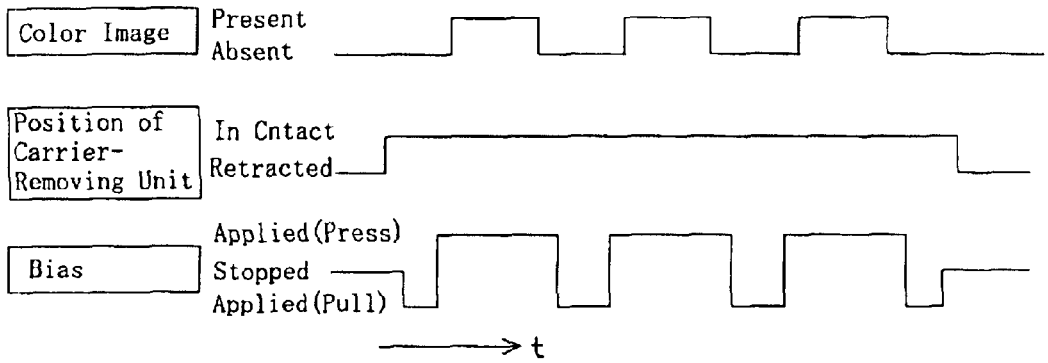
FIG. 16 is a timing chart showing a third example of timing control.

FIG. 16 is a timing chart showing a third example of the timing control. In the present example, while a non-image region is passing a point of contact between the conductive collection roller or belt and the image-bearing body, a bias voltage is inverted in polarity and hence applied in such a direction as to pull toner off the image-bearing body. The period of time during which a bias voltage in the pull-off direction is applied at a non-image region is provided between the time after the lapse of a predetermined time from when the carrier-removing unit assumes the in-contact position and the time a predetermined period of time earlier than when the carrier-removing unit assumes the retracted position.

According to this control, because a bias voltage is applied in such a direction as to pull toner off the image-bearing body, dirt on the image-bearing body is collected, whereby high-quality printed material can be provided.

Figure 17:
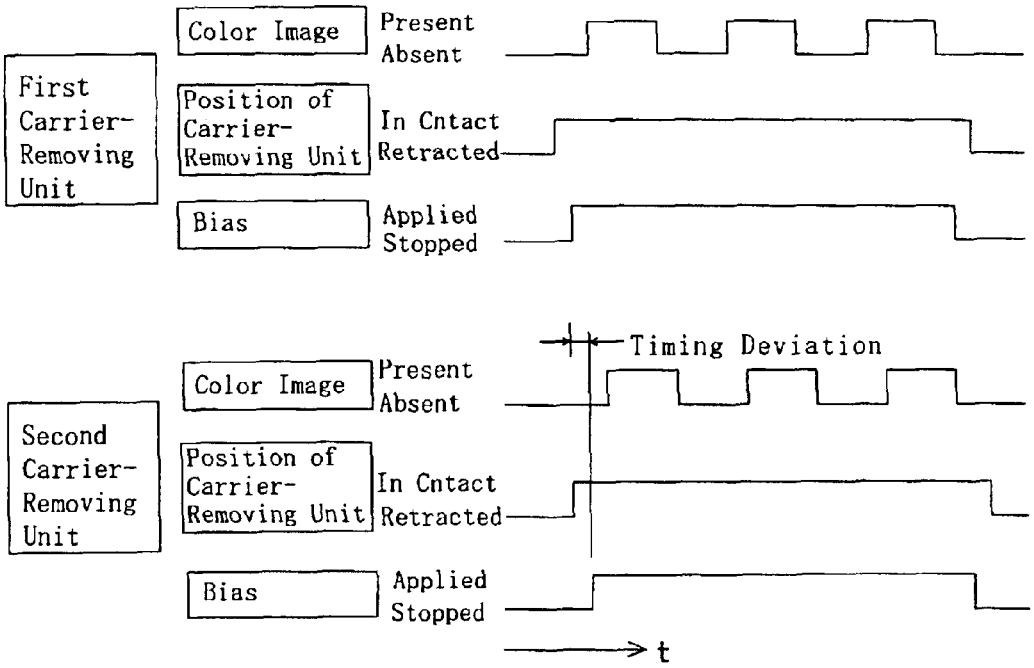
FIG. 17 is a timing chart showing a fourth example of timing control, explaining the timings of two carrier-removing units.
Figure 18:
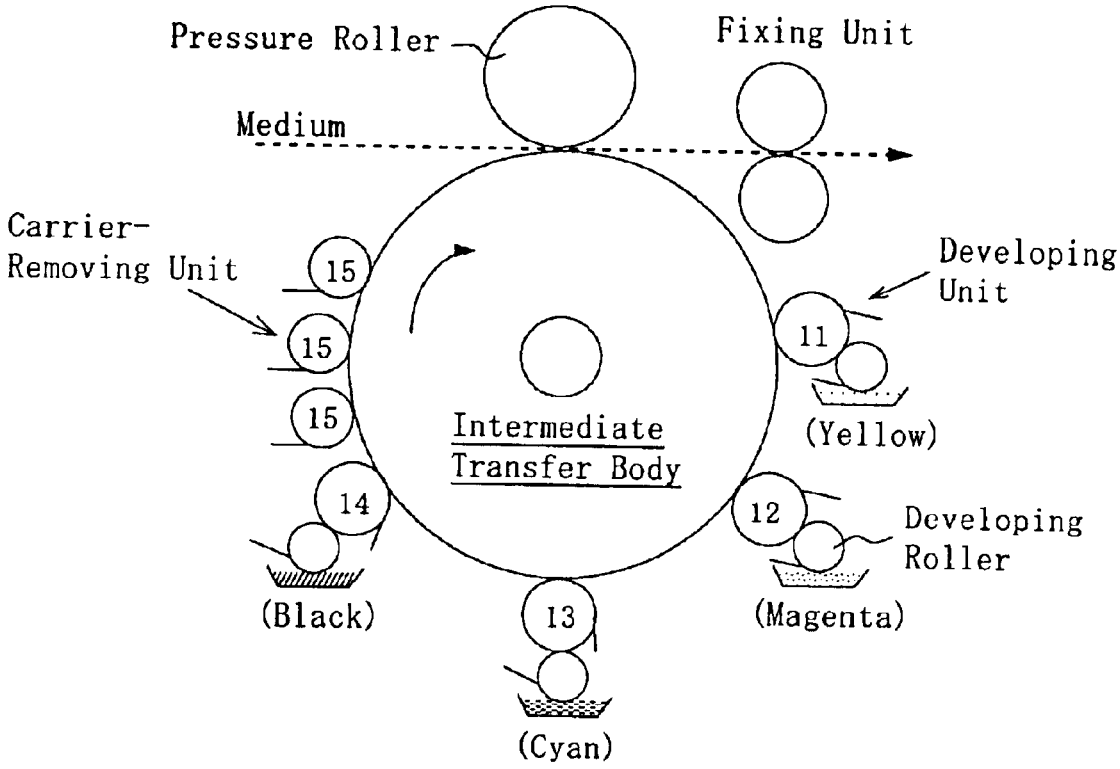
Fig. 18 Prior Art
FIG. 18 is a diagram showing the entire construction of a liquid-development electrophotographic apparatus according to a conventional technique.

FIG. 17 is a timing chart of a fourth example of the timing control, explaining the timings of operations between a plurality of (in the illustrated case, two) carrier-removing units. As described above with reference to FIGS. 1 and 2, the liquid-development electrophotographic apparatus includes a plurality of carrier-removing units. The plurality of carrier-removing units differ in both the timing of application of a bias voltage and the timing of discontinuation of the bias voltage application.

In FIG. 17, the respective timings of the first and second carrier-removing units, which account for all the illustrated units (two), are controlled in the same manner as in the example described above with reference to FIG. 14. In the example shown in FIG. 17, a deviation is provided with reference to both the timing of application of a bias voltage and the timing of discontinuation of the bias voltage application between the first and second carrier-removing units.

By the establishment of this timing deviation or shift, in the case of the apparatus equipped with a plurality of carrier-removing units, because the timing control is such that the timings of the bias voltage application for the respective carrier-removing units are not simultaneous with each other, a malfunction attributable to noise is prevented.

INDUSTRIAL APPLICABILITY

According to the present invention, even when superposition of toner images of different colors progresses, the amount of carrier present on the intermediate transfer body does not increase and does not raise a problem in image transfer from the photosensitive drum to the intermediate transfer body. As a result, conditions do not have to be set for every developing unit, and mal-transfer of image and disturbance of the already transferred image do not occur.

Further, according to the carrier-removing unit construction of the present invention, since cohesion of toner is increased through heating to a temperature higher than a toner softening temperature, no image impairment occurs, despite employment of a reserve-rotating roller, which is high in carrier collection efficiency.

Still further, according to the present invention, while the apparatus is stopped or on standby, the carrier-removing unit can be controlled so as not to be brought into contact with the image-bearing body, and the roller or belt suffers no contact mark (nip mark). As a result, image quality can be maintained even when carrier is removed.

In addition, according to the present invention, because a bias voltage can be applied to the roller or belt after the roller or belt is brought into contact with the image-bearing body, the apparatus does not suffer discharge of potential to the image-bearing body, malfunction, or formation of pinholes on the surfaces of the roller or belt and that of the image-bearing body attributable to discharge. Consequently image quality can be maintained.

What is claimed is:

1. A liquid-development electrophotographic apparatus for forming on an image-bearing body a plurality of color images that are developed by a plurality of developing units, one for each color, that use liquid toner, comprising a carrier-removing unit for removing excessive carrier from a toner layer formed on said image-bearing body, wherein said carrier-removing unit includes two or more conductive or semiconductive collection rollers to which a bias voltage is applied in such a direction as to press toner against said image-bearing body and which are adapted to be brought into contact with said image-bearing body, an upstream one of said carrier-removing units with respect to the direction of progress of a developing process having said collection rollers being rotated in the same direction as the direction of surface movement of said image-bearing body whereas a downstream one of said carrier-removing units with respect to the direction of progress of the developing process having said collection rollers being rotated in the opposite direction, each of said collection rollers being equipped with carrier collecting means.

2. A liquid-development electrophotographic apparatus according to claim 1, further comprising a heat generating unit for heating toner to a temperature near or higher than a softening temperature of resin contained in the liquid toner, and a control unit for maintaining the temperature of the toner constant.

3. A liquid-development electrophotographic apparatus according to claim 1, wherein said each collection roller has such a degree of elasticity and surface roughness that resin cohered by the bias voltage applied in such a direction so as to press the toner against said image-bearing body is allowed to pass without impairing the images.

4. A liquid-development electrophotographic apparatus for forming on an image-bearing body a plurality of color images that are developed by a plurality of developing units, one for each color, that use liquid toner, comprising a carrier-removing unit for removing excessive carrier from a toner layer formed on said image-bearing body, wherein said carrier-removing unit includes a conductive or semiconductive collection roller to which a bias voltage is being applied in such a direction as to press toner against said image-bearing body and which is adapted to be brought into contact with said image-bearing body and adapted to be rotated in a direction opposite that of surface movement of said image-bearing body, said collection roller being equipped with carrier collection means, said carrier-removing unit further including a conductive or semiconductive blade to which a bias voltage is applied in such a direction as to press toner against said image-bearing body and which is disposed upstream of said collection roller with respect to a process progress direction, and wherein said conductive or semiconductive blade is disposed in contact with or separated by a very small gap from said image-bearing body under such a degree of pressure and elasticity as not to impair the images, a distal end of said blade being disposed in the vicinity of a nip zone of said collection roller to thereby assume such an angle with respect to said image-bearing body as to receive toner.

5. A liquid-development electrophotographic apparatus according to claim 4, further comprising a heat generating unit for heating toner to a temperature near or higher than a softening temperature of resin contained in the liquid toner, and a control unit for maintaining the temperature of the toner constant.

6. A liquid-development electrophotographic apparatus according to claim 4, wherein said conductive or semiconductive blade is a double-layer structure composed of a low-resistance layer and a high-resistance layer, and said voltage is applied to said blade from said low-resistance layer.

7. A liquid-development electrophotographic apparatus according to claim 4, wherein said collection roller has such a degree of elasticity and surface roughness that resin cohered by a bias voltage in such a direction as to press toner against said image-bearing body is allowed to pass without impairing the image.

8. A liquid-development electrophotographic apparatus for forming on an image-bearing body a plurality of color images that are developed by a plurality of developing units one for each color, comprising a carrier-removing unit for removing excessive carrier from a toner layer formed on said image bearer structure, wherein said carrier-removing unit includes a conductive or semiconductive collection roller to which a bias voltage is applied in such a direction as to press the toner against said image-bearing body and which is adapted to be rotated in a direction opposite that of surface movement of said image-bearing body, said collection roller being equipped with carrier collecting means, said carrier-removing unit further including a corotron or scorotron device which is disposed upstream of said carrier collecting means with respect to a process progress direction and to which a bias voltage is applied in such a direction as to press the toner against said image-bearing body.

9. A liquid-development electrophotographic apparatus according to claim 8, further comprising a heat generating unit for heating the toner to a temperature near or higher than a softening temperature of resin contained in the liquid toner, by the time the formed image arrives at said carrier-removing unit; and a control unit for maintaining the temperature of the toner constant.

10. A liquid-development electrophotographic apparatus according to claim 8, wherein said collection roller has such a degree of elasticity and surface roughness that resin cohered by a bias voltage in such a direction as to press the toner against said image-bearing body is allowed to pass without impairing the image.

* * * * *